US007415214B2

(12) United States Patent
Sakita et al.

(10) Patent No.: US 7,415,214 B2
(45) Date of Patent: Aug. 19, 2008

(54) IMAGE FORMING APPARATUS AND METHOD FOR DETECTING AMOUNT OF REMAINING TONER

(75) Inventors: Hirofumi Sakita, Nara (JP); Hirokazu Izumi, Nara (JP); Hideyuki Nishimura, Osaka (JP); Hisaaki Kobayashi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 239 days.

(21) Appl. No.: 11/507,764

(22) Filed: Aug. 21, 2006

(65) Prior Publication Data

US 2007/0058996 A1 Mar. 15, 2007

(30) Foreign Application Priority Data

Sep. 12, 2005 (JP) ..... 2005-264473

(51) Int. Cl.
*G03G 15/08* (2006.01)

(52) U.S. Cl. ..... 399/27; 399/30

(58) Field of Classification Search ..... 399/9, 399/24, 25, 27, 29, 30, 252, 262
See application file for complete search history.

(56) References Cited

U.S. PATENT DOCUMENTS 7,003,233 B2 * 2/2006 Matsuda et al. ..... 399/27
7,218,869 B2 * 5/2007 Nakazato ..... 399/13
7,242,879 B2 * 7/2007 Kakuno et al. ..... 399/27

FOREIGN PATENT DOCUMENTS

| | | |
|---|---|---|
| EP | 1 610 189 A1 | 12/2005 |
| JP | 10-221944 | 8/1998 |
| JP | 10-333419 | 12/1998 |
| JP | 2004-163553 | 6/2004 |
| JP | 2004-163554 | 6/2004 |
| JP | 2004-317592 | 11/2004 |
| JP | 2005-148238 | 6/2005 |
| JP | 2005-173088 | 6/2005 |

* cited by examiner

*Primary Examiner*—Hoan H Tran
(74) *Attorney, Agent, or Firm*—David G. Conlin; Steven M. Jensen; Edwards Angell Palmer & Dodge LLP

(57) ABSTRACT

The image forming apparatus according to the present invention detects the amount of remaining toner by using (i) the result of calculation carried out by a toner supply amount calculation section based on an accumulated rotational time measurement section in a region where the amount of remaining toner is not less than a predetermined amount and toner supply is stabilized, (ii) the result of calculation carried out by a pixel count section in a region where the amount of remaining toner gets small and the amount of toner supply gets uneven, and (iii) the result of ATC carried out by a toner density control section. As a result, it is possible to exactly detect the amount of remaining toner without providing a special remaining toner detection device.

16 Claims, 11 Drawing Sheets

FIG. 7

WEIGHT COEFFICIENT TABLE (FIXED)

| | INPUT SIGNAL VALUE | WEIGHT COEFFICIENT TABLE |
|---|---|---|
| AREA 1 | 0~4 | 0 |
| AREA 2 | 5~8 | 1 |
| AREA 3 | 9~12 | 3 |
| AREA 4 | 13~15 | 4 |

IMAGE FORMING APPARATUS AND METHOD FOR DETECTING AMOUNT OF REMAINING TONER

This non-provisional application claims priority under 35 U.S.C. § 119(a) on Patent Application No. 2005-264473 filed in Japan on Sep. 12, 2005, the entire contents of which are hereby incorporated by reference.

FIELD OF THE INVENTION

The present invention relates to an image forming apparatus, forming images by use of toner, which is capable of exactly detecting the amount of remaining toner until the toner runs out.

BACKGROUND OF THE INVENTION

In an image forming apparatus for forming images by use of toner, such as a printer, a copying machine, and a facsimile, it is necessary to grasp the amount of remaining toner for convenience of maintenance such as toner supply.

However, in a case where an image forming apparatus is provided with a remaining toner detection device, the cost inevitably increases. Therefore, there has been used a technique in which the amount of remaining toner is detected by use of existing members.

For example, Japanese Unexamined Patent

Publication No. 221944/1998 (Tokukai 10-221944; published on Aug. 21, 1998) discloses a technique in which: when two-component developer is used, the amount of remaining toner is detected based on the result of Auto Toner Control (ATC).

ATC is a method for controlling toner density of developer so that the toner density is constant based on magnetic permeability of the developer. Two-component developer is constituted of (i) carrier made of iron powder and the like and (ii) toner with predetermined density (e.g. 4 to 5%). As such, when toner in the developer is used and the ratio of carrier increases, the magnetic permeability of the developer increases. Therefore, by detecting the magnetic permeability of the developer, it is possible to grasp the ratio of toner in the developer.

Examples of ATC include (i) a technique in which: when magnetic permeability rises and exceeds an upper limit (corresponding to a lower limit of toner density), a supply motor is rotated for a predetermined time (alternatively, predetermined number of rotations) and toner is supplied from a toner supply source such as a toner bottle, and (ii) a technique in which: a lower limit of magnetic permeability (corresponding to an upper limit of toner density) is previously set and when the magnetic permeability rises and exceeds an upper limit, a supply motor is rotated until the magnetic permeability falls to the lower limit, thereby supplying toner from the toner supply source.

In either technique, as the amount of remaining toner in the toner supply source drops, the effect of drop appears in ATC. The result of ATC allows detection of the amount of remaining toner. Namely, in the technique (i), the amount of toner supply per a predetermined time for rotating the supply motor is reduced, so that toner supply is frequently repeated, which makes it possible to detect that the amount of remaining toner is small. Further, in the technique (ii), the amount of toner supply per a predetermined time for rotating the supply motor is reduced, so that the time for toner supply (time taken for the magnetic permeability to fall to the lower limit) becomes long, which makes it possible to detect that the amount of remaining toner is small.

Thereafter, when the supply motor is rotated for a predetermined time (e.g. 3 seconds) but the magnetic permeability does not have the former value, namely, when the toner density does not increase, toner empty (toner run out, toner end) is detected.

Further, examples of a conventional technique for detecting the amount of consumed toner or remaining toner by use of existing members other than ATC are as follows.

Japanese Unexamined Patent Publication No. 163553/2004 (Tokukai 2004-163553; published on Jun. 10, 2004) discloses a technique in which: the number of formed printing dots is counted, the counted number is multiplied by a predetermined weight coefficient, thus multiplied number is accumulated and, based on thus accumulated number, the amount of toner consumption is obtained. Further, Japanese Unexamined Patent Publication No. 163553/2004 discloses that the weight coefficient is modified according to the history of toner use.

Further, Japanese Unexamined Patent Publication No. 163554/2004 (Tokukai 2004-163554; published on Jun. 10, 2004) discloses a technique in which the amount of remaining toner is obtained in such a manner that (i) the number of printing dots is counted based on image signals and the amount of toner consumption is calculated based on the counted number, and (ii) in an operation mode such as a density control mode which includes formation of a patchwork image, the amount of toner consumption is calculated according to a pattern of the patchwork image.

Further, Japanese Unexamined Patent Publication No. 333419/1998 (Tokukaihei 10-333419; published on Dec. 18, 1998) discloses a technique in which: a toner supply function for converting a video count value of an image in to a time for toner supply is corrected while being weighted by a video count value of an image under formation, and thus the amount of toner supply is corrected so as to correspond to the amount of toner consumption.

However, the conventional techniques for detecting the amount of remaining toner by use of existing members have the following problems to be solved.

For example, in the technique disclosed in Japanese Unexamined Patent Publication No. 221944/1998 for detecting the amount of remaining toner by carrying out ATC, it is impossible to chronologically detect the amount of remaining toner from a time when the toner is fully contained to a time when the toner runs out. Hence there is not an enough time for a user to prepare toner to be subsequently used, so that the operation rate of the image forming apparatus drops.

Namely, in ATC, it is not until the amount of remaining toner is much reduced that toner supply is frequently repeated or that it takes much time to supply toner per each supply. When the amount of remaining toner is much reduced, the number of printable sheets is only 50 to 100 (the number depends on the size of a sheet and a printing ratio). As a result, though a user is informed that the amount of remaining toner is small at a time when such state is detected, it is much likely that the toner runs out before next toner is prepared, resulting in that the image forming apparatus is stopped.

On the other hand, in the techniques not using ATC, disclosed in Japanese Unexamined Patent Publication No. 163553/2004, Japanese Unexamined Patent Publication No. 163554/2004, and Japanese Unexamined Patent Publication No. 333419/1998, the amount of toner to be used is exactly calculated based on image signals or patterns of patchwork images, and is regarded as the amount of toner consumption.

Therefore, by obtaining the amount of remaining toner based on thus obtained amount of toner consumption, it is possible to detect that the amount of remaining toner is small before ATC does so that the detection result is informed to the user.

However, the actual amount of toner on a photoconductor is not constant because of the environment or variations in devices. Therefore, even though the amount of remaining toner is more exactly detected based on weighting or the like, it is difficult to determine whether toner runs out or not based only on the result of weighting.

Therefore, even though the user is informed that the amount of remaining toner is small under a condition that enough sheets are provided so as to be printed, toner may run out before a predetermined number of sheets are printed or toner may be judged to run out while the toner still remains.

SUMMARY OF THE INVENTION

The present invention was made in view of the foregoing problems. An object of the present invention is to provide an image forming apparatus and a method for detecting the amount of remaining toner, each of which allows exact detection of the amount of remaining toner without providing a device specially used to detect the amount of remaining toner. Another object of the present invention is to provide an image forming apparatus capable of informing a user of information concerning toner at a suitable timing based on the detected amount of remaining toner.

In order to achieve the foregoing object, the image forming apparatus according to the present invention is an image forming apparatus, which uses two-component developer constituted of toner and carrier and includes a toner density control section for supplying the toner from a supply device to a developing device on the basis of magnetic permeability of the developer so as to cause toner density in the developing device to be constant, the image forming apparatus comprising a remaining toner amount detection section for detecting the amount of remaining toner in the supply device, wherein the remaining toner amount detection section includes: a toner supply amount calculation section for calculating the amount of toner supply on the basis of the accumulated number of rotations of a supply motor which is rotated so as to supply toner from the supply device to the developing device; a toner consumption amount calculation section for calculating the amount of toner consumed by forming an image on the basis of image information; and the toner density control section, and the remaining toner amount detection section detects the amount of remaining toner on the basis of (i) the result of calculation carried out by the toner supply amount calculation section till the amount of remaining toner in the supply device reaches a first predetermined value, (ii) the result of calculation carried out by the toner consumption amount calculation section from a time when the amount of remaining toner in the supply device reaches the first predetermined value till the amount of remaining toner in the supply device reaches a second predetermined value, and (iii) the result of control carried out by the toner density control section from a time when the amount of remaining toner in the supply device reaches the second predetermined value.

With the arrangement, the amount of remaining toner in the supply device is detected on the basis of (i) the amount of toner supply which is calculated by the toner supply amount calculation section based on the accumulated number of rotations of the supply motor till the amount of remaining toner in the supply device reaches the first predetermined value, (ii) the amount of toner consumption which is calculated by the toner consumption amount calculation section based on the image information from the time when the amount of remaining toner in the supply device reaches the first predetermined value till the amount of remaining toner in the supply device reaches the second predetermined value, and (iii) the result of control carried out by the toner density control section from the time when the amount of remaining toner in the supply device reaches the second predetermined value.

Namely, the amount of remaining toner is detected based on the accumulated number of rotations of the toner motor in a region where the amount of remaining toner in the supply device is a predetermined amount or more and changes linearly in accordance with the number of rotations or the rotational time of the supply motor, resulting in the stabilized amount of toner supply. Further, the amount of remaining toner is detected by expecting the amount of consumed toner based on the image information in a region where the amount of remaining toner in the supply device gets small and the amount of toner supply gets uneven. Further, the amount of remaining toner is detected by using the result of control carried out by the conventional toner density control section in a region where the amount of toner is near end.

As a result, it is possible to detect the amount of remaining toner according to actually remaining toner, and accordingly it is possible to exactly detect the amount of remaining toner from a time when toner is fully contained to a time when toner runs out without providing a special remaining toner detection device.

Further, unlike the detection carried out only by ATC with respect to the amount of remaining toner, it is possible to chronologically detect the amount of remaining toner from a time when toner is fully contained to a time when toner runs out, so that it is easy to inform the user of information regarding toner at a suitable timing.

The image forming apparatus according to the present invention further includes an informing section for causing a display section to inform a user that preparation of toner is necessary, and the informing section causes the display section to inform the user that preparation of toner is necessary when detection carried out by the remaining toner amount detection section with respect to the amount of remaining toner shows that the amount of remaining toner in the supply device reaches a third predetermined value which is set in accordance with the amount of used toner per days taken for the user to obtain a supply device for exchange.

With the arrangement, when the amount of remaining toner reaches the third predetermined value which is set in accordance with the amount of used toner per days taken for the user to obtain the supply device for exchange, the informing section causes the display section to urge preparation of toner, so that the user can prepare the next toner at a suitable timing and accordingly it is possible to prevent reduction of the operation rate of the image forming apparatus.

The method according to the present invention for detecting the amount of remaining toner is a method for detecting the amount of remaining toner in a supply device applied to an image forming apparatus that uses two-component developer constituted of toner and carrier and that includes a toner density control section for supplying toner from the supply device to a developing device on the basis of magnetic permeability of the developer so as to cause toner density in the developing device to be constant, the method comprising the steps of: (i) detecting the amount of remaining toner in the supply device on the basis of the accumulated number of rotations of a supply motor which supplies the toner from the supply device to the developing device; (ii) detecting the amount of remaining toner in the supply device on the basis of the amount of toner consumed by forming an image on the basis of image information; and (iii) detecting the amount of remaining toner in the supply device on the basis of the result of control carried out by the toner density control section, wherein the method performs the step (i) when the amount of remaining toner in the supply device is large and changes linearly in accordance with the accumulated number of rotations of the supply motor, the method switches to the step (ii) when the amount of remaining toner in the supply device reaches a region where the amount is small and does not change linearly in accordance with the accumulated number of rotations of the supply motor, and the method switches to the step (iii) when the amount of remaining toner reaches a region where the amount is substantially 0.

In the method for detecting the amount of remaining toner as well as in the image forming apparatus already explained above, it is possible to detect the amount of remaining toner according to actually remaining toner, and accordingly it is possible to exactly detect the amount of remaining toner from a time when toner is fully contained to a time when toner runs out without providing a special remaining toner detection device and it is possible to inform the user of information concerning toner at a suitable timing.

Note that, the present invention may be realized by a computer. In that case, (i) a remaining toner detection program for causing a computer to function as sections included in the image forming apparatus according to the present invention and (ii) a computer-readable storage medium for storing the program, are also within the scope of the present invention.

For a fuller understanding of the nature and advantages of the invention, reference should be made to the ensuing detailed description taken in conjunction with the accompanying drawings.

BRIEF DESCRIPTION OF THE DRAWINGS

FIG. 7 illustrates contents of a weight coefficient table.

DESCRIPTION OF THE EMBODIMENTS

The following explains an embodiment of the present invention with reference to FIGS. 1 to 11.

Figure 2:
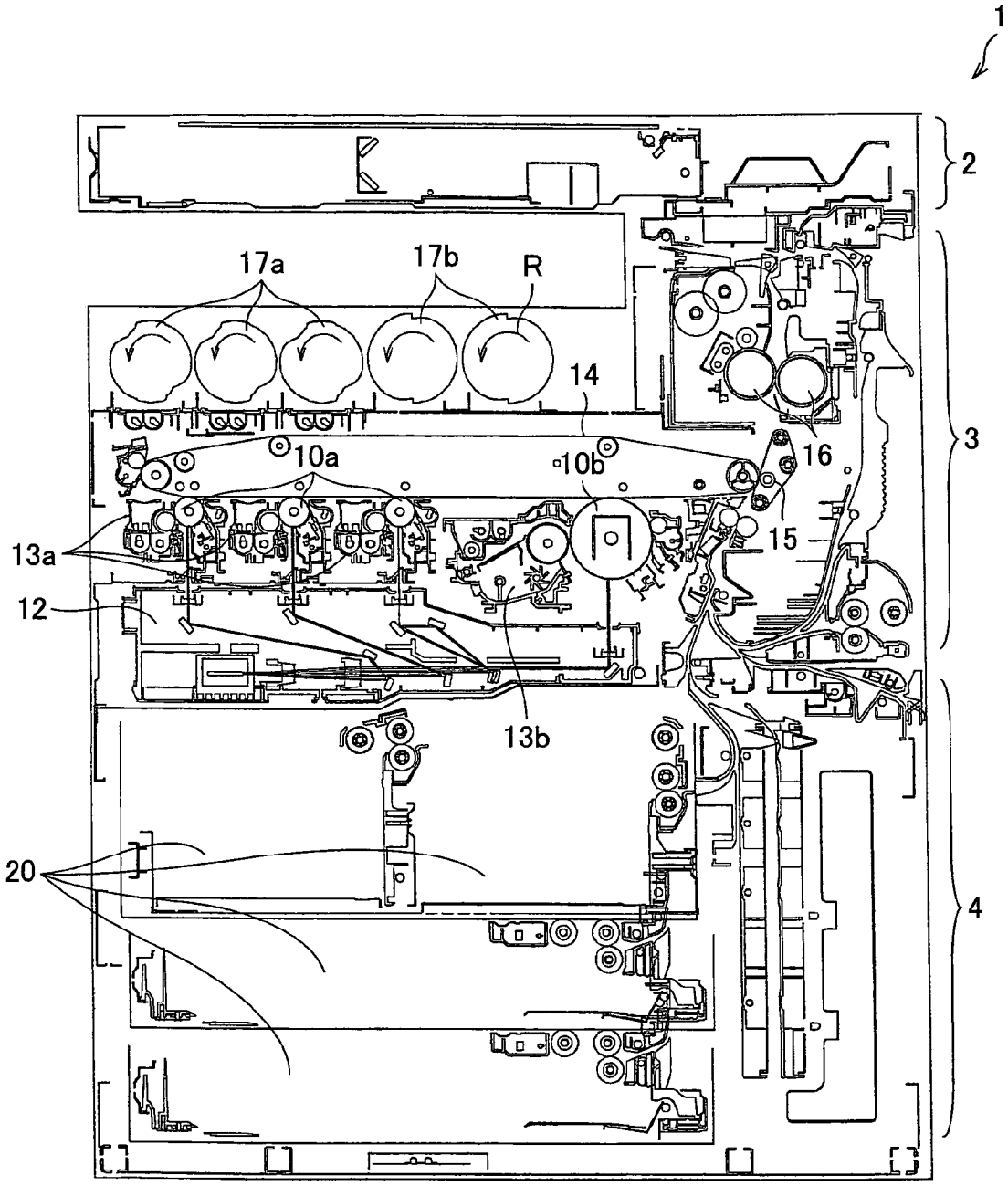
FIG. 2 illustrates a longitudinal section of the image forming apparatus.

FIG. 2 illustrates a longitudinal section of an image forming apparatus according to the present embodiment. As illustrated in FIG. 2, an image forming apparatus 1 includes: an image reading device (scanner) 2 for reading a document by use of a CCD (Charge Coupled Device) and the like and outputting an image signal; a printer 3 for forming (printing) an image on a sheet based on the image signal; and a sheet feeding desk device 4 for serially supplying sheets to the printer 3.

The printer 3 includes three color photoconductor drums 10*a* respectively corresponding to magenta, cyan, and yellow and a black photoconductor drum 10*b* which is larger than each color photoconductor drum 10*a*. An optical unit (LSU) 12 writes electrostatic latent images on the photoconductor drums 10. The writing is digitally controlled.

At the vicinity of each of the photoconductor drums 10, there is provided a developing device 13 which contains corresponding developer out of magenta, cyan, yellow, and black, and develops an electrostatic latent image on the photoconductor drum 10. In the present invention, developer is two-component developer which is a mixture of (i) carrier made of iron powder and the like and (ii) toner with predetermined density (e.g. 4 to 5%).

At the vicinity of each of the photoconductor drums 10, in addition to the developing device 13, there are provided known members in a Carlson process, such as a charger, a cleaner, a transfer device (used to transfer an image from the photoconductor drum 10 to a transfer belt 14), and the like.

In the arrangement illustrated in FIG. 2, the transfer belt 14 is provided so as to be in contact with each of the photoconductor drums 10. Toner images (visible images) formed on the respective photoconductor drums 10 are transferred onto the transfer belt 14 so as to serially overlap each other. Thereafter, a second transfer unit 15 transfers the image onto a paper supplied from a paper feeding desk device 4 including a plurality of paper feeding cassettes 20. In a direction in which the paper having passed through the second transfer unit 15 is conveyed, there is provided a fixing device including a fixing roller 16. The toner image transferred onto the paper is fixed onto the paper by passing through the fixing device.

The paper onto which the toner image has been fixed is then delivered to a space between the image reading device 2 and the printer 3 or inversely conveyed and delivered to the second transfer unit 15 again.

Above the transfer belt 14, there are provided color toner bottles 17 which respectively contain magenta, cyan, and yellow, and two toner bottles 17*b* which are one size larger than the color toner bottle 17 and which contain black toner. Each of the toner bottles (supply device) 17 supplies toner contained therein to the developing device 13 corresponding to each of the toner bottles 17. Each of the toner bottles 17 is rotated by a driving force transmitted from a toner motor (supply motor) (not shown) to each of the toner bottles 17. Each of the toner bottles 17 supplies toner while being rotated.

Figure 11:
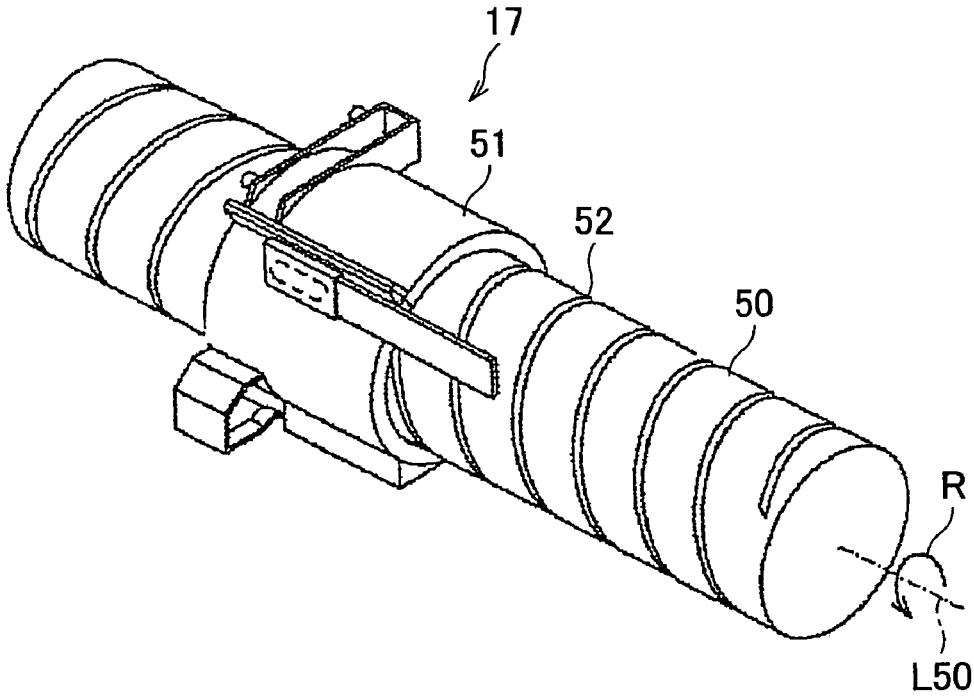
FIG. 11 is an oblique view illustrating a toner bottle provided in the image forming apparatus.

Further, the toner bottle 17 is provided so as to be detachable from the image forming apparatus 1. As such, when toner in the toner bottle 17 is consumed, it is possible to replace the toner bottle 17 with a new one. In the image forming apparatus 1, the toner bottle has a cylindrical shape and is rotatable as illustrated in FIG. 11. An example of the cylindrical toner bottle is disclosed in Japanese Unexamined Patent Publication No. 317592/2004 (Tokukai 2004-317592; published on Nov. 11, 2004).

The toner bottle 17 includes a bottle main body 50 for containing toner and a supporting material 51 for supporting the bottle main body 50 so that the bottle main body 50 is rotatable. As indicated by an arrow R in FIG. 11, the bottle main body 50 is rotated so that an axis L 50 of the bottle main body 50 is a rotational axis. On the circumferential face of the bottle main body 50, there is formed a groove 52 having an inclined shape. The groove 52 has a convex shape on the inner wall of the bottle main body 50. When the bottle main body 50 is rotated, toner in the bottle main body 50 is guided by the groove 52 to a supply port. The toner bottle 17 having such a mechanism is stable in terms of the amount of toner supply per one rotation.

Figure 1:
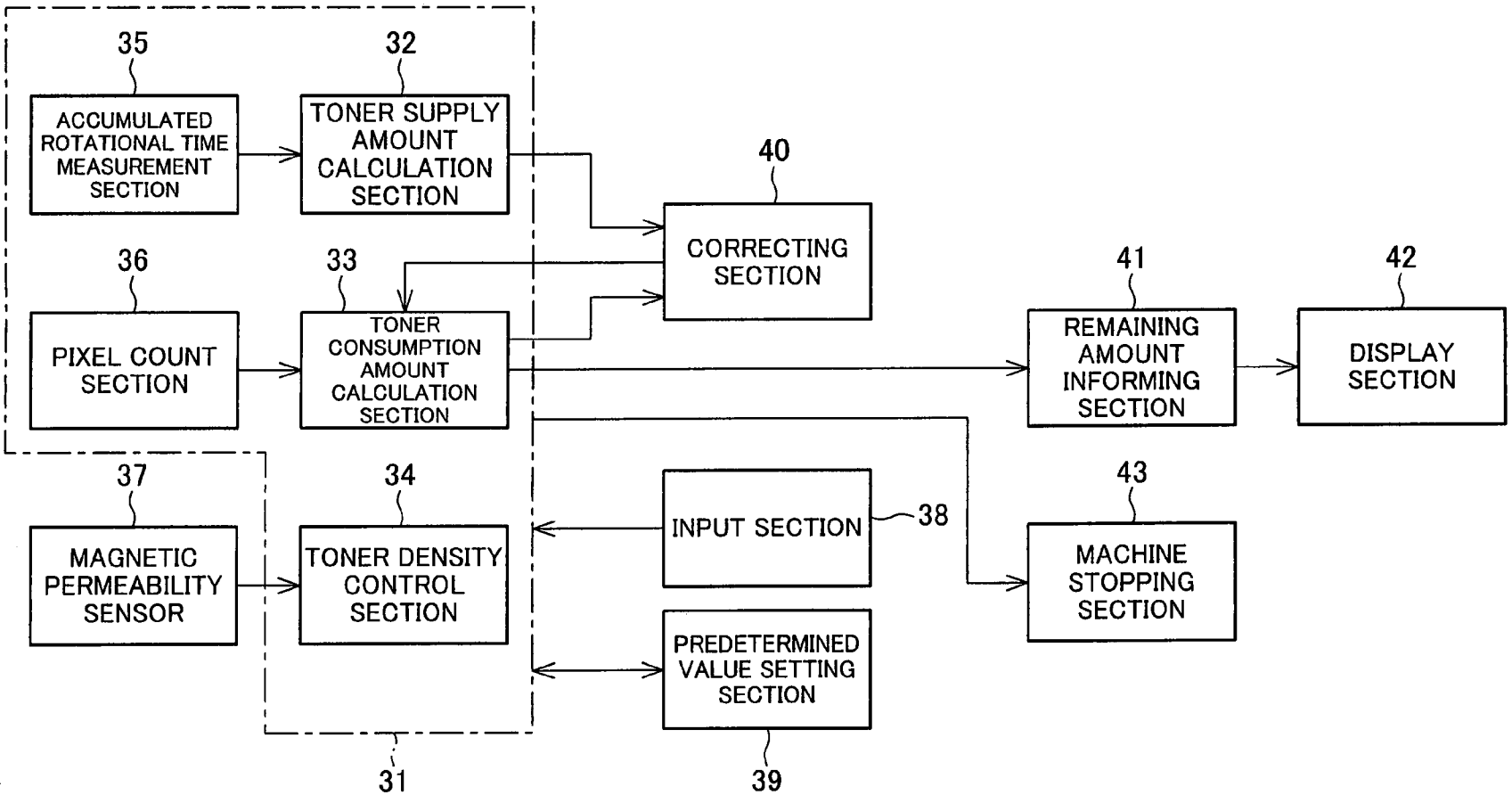
FIG. 1 is a functional block diagram illustrating an essential structure of an image forming apparatus according to an embodiment of the present invention.

With reference to FIG. 1, the following details a process of the image forming apparatus 1 according to the present embodiment, in which process the amount of remaining toner is detected and a user is informed of the amount of remaining toner based on the result of detection. FIG. 1 is a control block diagram illustrating essential parts of the image forming apparatus 1.

As illustrated in FIG. 1, the image forming apparatus 1 includes a remaining toner amount detection section (remaining toner amount detection means) 31, a magnetic permeability sensor 37, a predetermined value setting section (predetermined value setting means) 39, a correcting section (correcting means) 40, an input section 38, a remaining amount informing section (informing means, informing section) 41, a display section 42, and a machine stopping section 43.

The remaining toner amount detection section 31 detects the amount of remaining toner in the toner bottle 17 and includes a toner supply amount calculation section (toner supply amount calculation means) 32, a toner consumption amount calculation section (toner consumption amount calculation means) 33, a toner density control section (toner density control means) 34, an accumulated rotational time measurement section (toner supply amount calculation means, toner supply amount calculation section) 35, and a pixel count section (toner consumption amount calculation means, toner consumption amount calculation section) 36.

The remaining toner amount detection section 31 detects the amount of remaining toner based on the result of calculation carried out by the toner supply amount calculation section 32 until the amount reaches a first predetermined value. When the amount reaches the first predetermined value, the remaining toner amount detection section 31 detects the amount based on the result of calculation carried out by the toner consumption amount calculation section 33 until the amount reaches a second predetermined value. When the amount reaches the second predetermined value, the remaining toner amount detection section 31 detects the amount based on the result of control carried out by the toner density control section 34.

Figure 3:
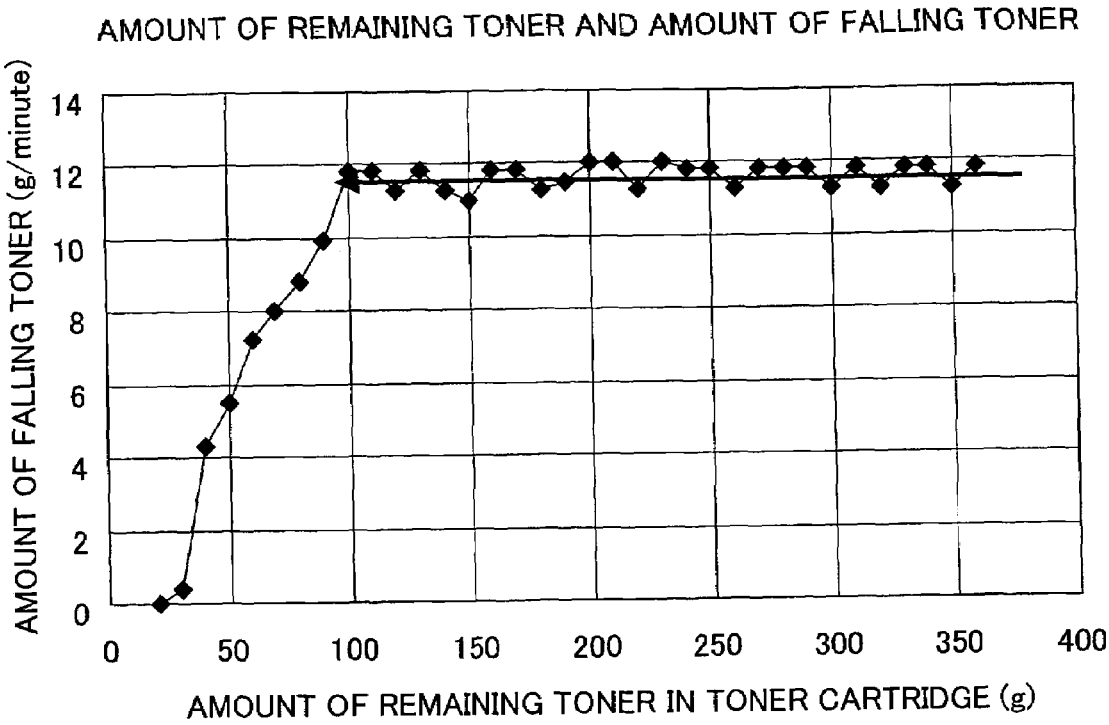
FIG. 3 is a graph illustrating a relation between the amount of remaining toner in a toner bottle and the amount of toner falling from the toner bottle.

The toner supply amount calculation section 32 calculates the amount of toner supplied from the toner bottle 17 to the developing device 13 based on the accumulated number of rotations of a toner motor which is measured by the accumulated rotational time measurement section 35. Here, FIG. 3 illustrates a relation between the amount of remaining toner in the toner bottle 17 and the amount of toner falling into the developing device 13 (corresponding to the amount of toner supply). As illustrated in FIG. 3, while the amount of remaining toner ranges from the initial remaining amount 360 g (full) to 100 g, the amount of falling toner is constant. When the amount of remaining toner is less than 100 g, the amount does not change linearly. This is because: as the amount of remaining toner drops, the amount of air included in toner increases, and thus the amount of toner supply becomes unstable.

Figure 4:
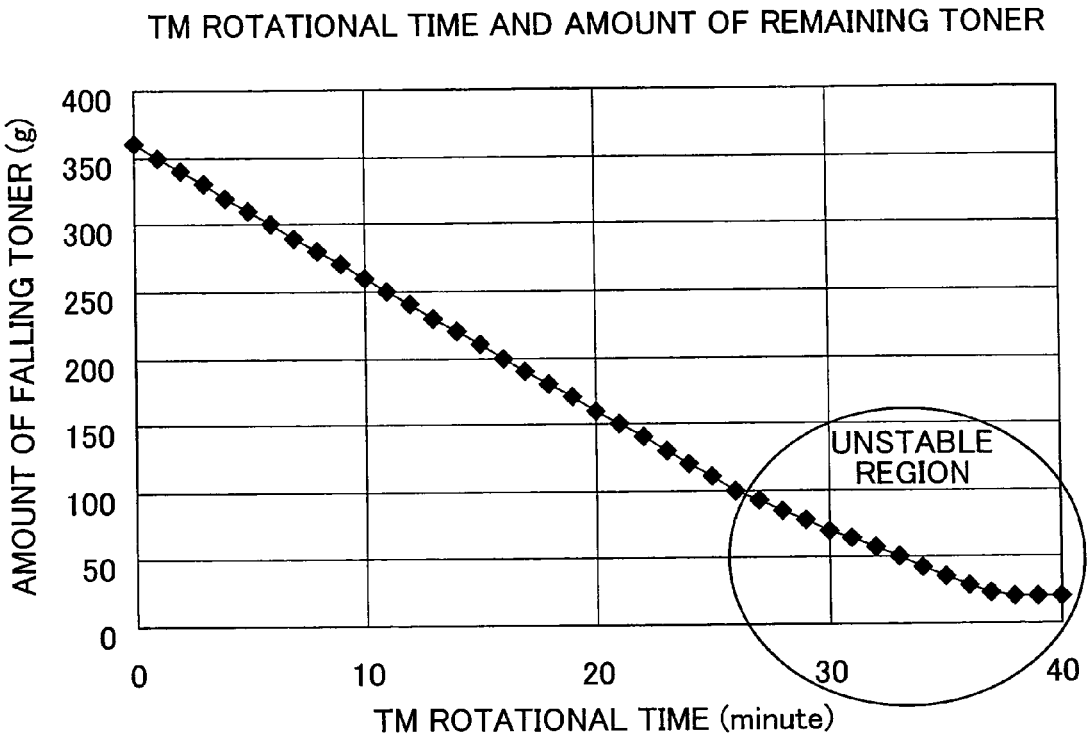
FIG. 4 is a graph illustrating a relation between rotational time of a toner motor and the amount of remaining toner in the toner bottle.

Further, FIG. 4 illustrates a relation between the rotational time of the toner motor and the amount of remaining toner in the toner bottle 17. In this relation, too, the amount of remaining toner in the toner bottle 17 changes linearly while the amount ranges from 360 g (full) to 100 g, but does not change linearly when the amount is less than 100 g.

Therefore, in the example illustrated in FIGS. 3 and 4, while the amount of remaining toner is 100 g or more, accumulation of the time during which the toner motor is rotated (in other words, accumulation of the number of rotations of the toner motor) allows calculation of the amount of toner supplied from the toner bottle 17 to the developing device 13. Such calculation of the amount of toner supply based on the accumulated rotational time of the toner motor is exact as well as easy.

The toner consumption amount calculation section 33 calculates the amount of toner consumed by forming images based on image information. Here, the amount of toner consumption is calculated based on the result of pixel count carried out by the pixel count section 36. The pixel count section 36 performs pixel count of an image signal having been subject to a half tone correction process or the like while multiplying the image signal by a weight coefficient with respect to each of CMYK signals by each pixel. Calculation carried out by the pixel count section 36 and the toner consumption amount calculation section 33 with respect to the amount of toner consumption is detailed later.

The toner density control section 34 controls toner density in the developing device 13 based on the magnetic permeability of the developer which is detected by the magnetic permeability sensor 37. As is already explained, a conventional image forming apparatus using two-component developer performs a control for supplying toner from the toner bottle 17 to the developing device 13 based on the magnetic permeability of developer in the developing device 13 and thus keeping the toner density in the developing device 13 in a constant value (this control is referred to as "ATC" hereinafter).

Here, when the magnetic permeability rises and the toner density becomes equal to a lower limit or less, the toner density control section 34 causes the toner motor to rotate for a predetermined time $T_1$, thereby supplying toner from the toner bottle 17. Note that, the present invention may be arranged so that: an upper limit of toner density is also specified and when the toner density is less than the lower limit, the toner motor is rotated until the toner density reaches the upper limit of the toner density, thereby supplying toner from the toner bottle 17.

The remaining toner amount detection section 31 detects that toner will soon run out, namely, "near end", when a process is repeated in which: the toner density control section 34 performs ATC and rotates the toner motor for a predetermined time, the toner density again has a value equal to the limit or less after a short interval, and the toner density control section 34 performs ATC again.

Further, the remaining toner amount detection section 31 detects that toner runs out when the toner density continues to have a value equal to the lower limit or less after the toner density control section 34 performs ATC and rotates the toner motor for a predetermined time and the toner density still continues to have a value equal to the lower limit or less after a predetermined time $T_2$ (e.g. 5 seconds) passes.

The first predetermined value at which the method for detecting the amount of remaining toner is changed from a method based on the result of calculation carried out by the toner supply amount calculation section 32 to a method based on the result of calculation carried out by the toner consumption calculation section 33 is a value within a region where the amount of remaining toner in the toner bottle 17 changes linearly in accordance with the accumulated rotational time (accumulated number of rotations) of the toner motor. The first predetermined value is preferably the lower limit of the region. In the example illustrated in FIGS. 3 and 4, the first predetermined value should be 100 g.

The second predetermined value at which the method for detecting the amount of remaining toner is changed from a method based on the result of calculation carried out by the toner consumption calculation section 33 to a method based on the result of control carried out by the toner density control section 34 is a value which allows detection of the amount of remaining toner based on the result of control carried out by the toner density control section 34 even when an error occurs in calculation carried out by the toner consumption amount calculation section 33. In the present embodiment, the second predetermined value is equal to a later-mentioned limit amount $W_L$ (third predetermined value) for determining a timing at which a message for urging the user to prepare toner is displayed.

The remaining amount informing section 41 causes the display section 42 to display information concerning the amount of remaining toner in the toner bottle 17 based on detection carried out by the remaining toner amount detection section 31 with respect to the amount of remaining toner. Here, according to the detected amount of remaining toner, three items of information: (i) a new toner bottle 17 for exchange should be prepared, (ii) the toner bottle 17 in use should be exchanged, and (iii) toner runs out, are displayed.

When the amount of remaining toner detected by the remaining toner amount detection section 31 reaches the limit amount $W_L$ (third predetermined value), the remaining amount informing section 41 causes the display section 42 to display a message such as "please prepare a new toner bottle". It is preferable that the limit amount $W_L$ is set with respect to each user. The limit amount $W_L$ should be set so as to have a value obtained by multiplying (i) the amount of toner consumption per a day with respect to a user by (ii) the number of days taken for the user to obtain a new toner bottle 17 with which the user exchanges the toner bottle 17 in use. As a result, it is possible to display the message at a suitable timing.

Further, when the remaining toner amount detection section 31 detects that toner is near end, the remaining amount informing section 41 causes the display section 42 to display a message such as "please exchange the toner bottle".

Further, when the remaining toner amount detection section 31 detects that toner runs out, the remaining amount informing section 41 causes the display section 42 to display a message such as "toner runs out".

When the remaining toner amount detection section 31 detects that toner runs out, the machine stopping section 43 stops operation of the image forming apparatus 1.

The input section 38 allows external setting of the first and second predetermined values, the limit amount $W_L$, a second limit amount $W_P$, and the like. The first and second predetermined values vary with respect to each image forming apparatus and vary because of version up/down of the toner bottle. Therefore, by allowing such external setting, it is possible to handle variation with respect to each image forming apparatus or version up/down of the toner bottle. Further, because the limit amount $W_L$ and the second limit amount $W_P$ are different with respect to each user, by allowing a service person or the like to suitably set the amounts via the input section 38, it is possible to inform the message at a more suitable timing.

The predetermined value setting section 39 sets the limit amount $W_L$ (third predetermined value) based on calculation. To be specific, the predetermined value setting section 39 includes a consumption amount/day calculation section (consumption amount/day calculation means) and a predetermined value calculation section (predetermined value calculation means). The consumption amount/day calculation section subtracts the first predetermined value from the initial amount of toner in the toner bottle 17 and divides thus obtained value by elapsed days which have elapsed from the day when the toner bottle 17 was exchanged to the day when the amount of remaining toner reaches the first predetermined value, thereby calculating the consumption amount per day. The predetermined value calculation section multiplies (i) the consumption amount/day calculated by the consumption amount/day calculation section by (ii) preparation days having been set with respect to each user, thereby calculating the limit amount $W_L$.

The preparation days here are days taken for the user to prepare a toner bottle 17 for exchange. The preparation days as well as the initial amount of toner can be input via the input section 38. On the other hand, the elapsed days can be obtained by calculating the number of days having passed from the day when the toner bottle 17 was exchanged (the days are stored in a memory or the like (not shown)) to the day when the amount of remaining toner reaches the first predetermined value.

Installation of the predetermined value setting section 39 allows the user to be informed of the message at a more suitable timing, and thus it is possible to urge the user to prepare toner exactly at a timing desired by the user (including preparation days) in consideration of the amount of toner recently consumed by the user.

The correcting section 40 corrects the calculated amount of toner consumption, which amount has been calculated by the toner consumption amount calculation section 33. While the amount of toner has not yet reached the first predetermined amount, the correcting section 40 causes the pixel count section 36 and the toner consumption amount calculation section 33 to calculate the amount of toner consumption as well as causes the toner supply amount calculation section 32 to calculate the amount of toner supply, and the correcting section 40 causes the toner consumption amount calculation section 33 (alternatively, the pixel count section 36, or both) to correct the amount of toner consumption on the basis of the amount of toner supply calculated by the toner supply amount calculation section 32.

For example, in a case where calculation carried out by the toner supply amount calculation section 32 so as to obtain the amount of toner supply indicates 250 g, while calculation carried out by the toner consumption amount calculation section 33 so as to obtain the amount of toner consumption indicates 260 g, the toner consumption amount calculation section 33 is caused to correct the calculated amount of toner consumption so that the calculated amount of toner consumption is 250 g which is equal to the calculated amount of toner supply.

Figure 5:
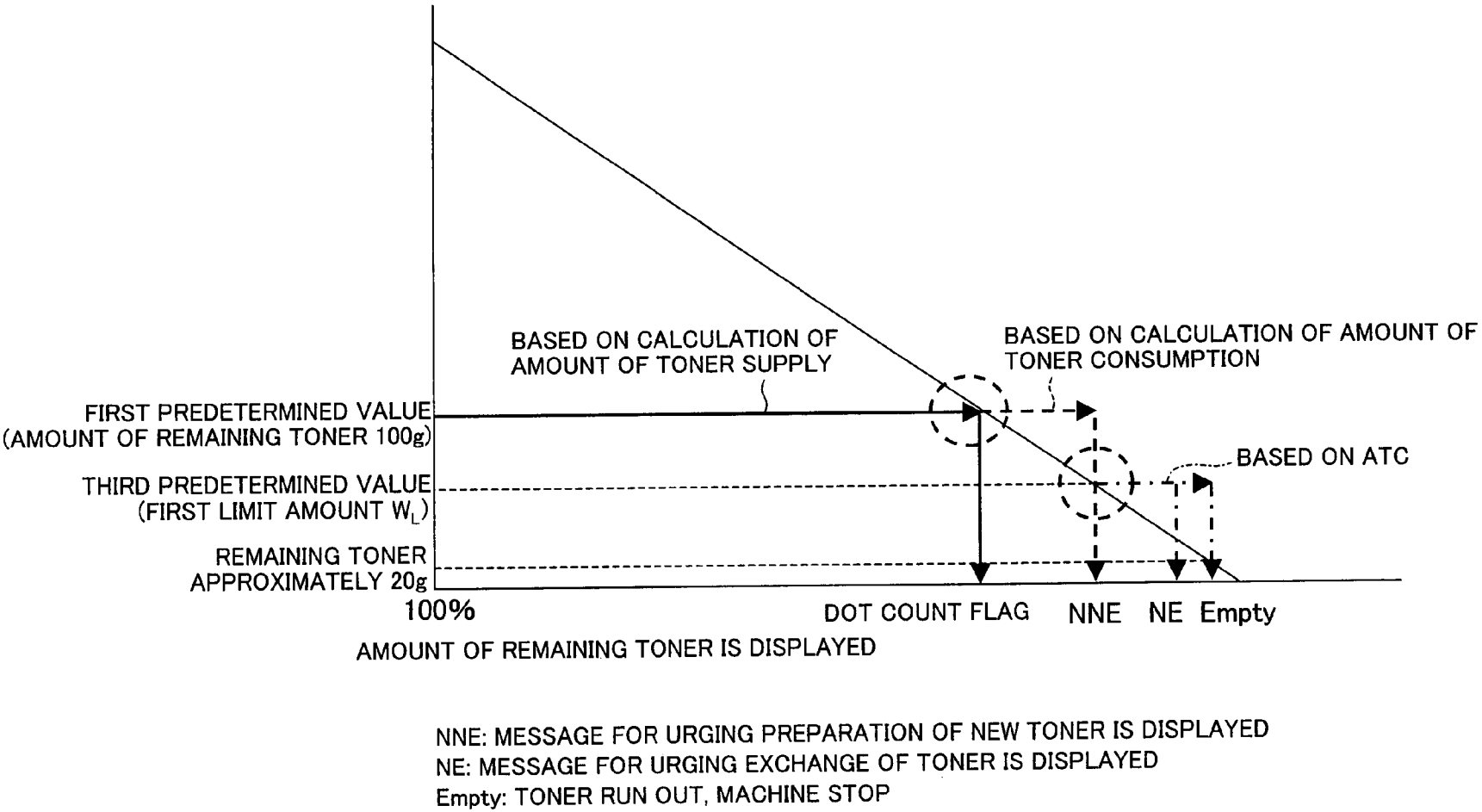
FIG. 5 schematically illustrates (i) switching of methods for detecting the amount of remaining toner by a remaining toner amount detection section and (ii) timing at which a remaining amount informing section causes the amount of remaining toner and information concerning the amount of remaining toner to be displayed.

FIG. 5 schematically illustrates (i) switching of methods for detecting the amount of remaining toner by the remaining toner amount detection section 31 and (ii) timing at which the remaining amount informing section 41 causes the amount of remaining toner and information concerning the amount of remaining toner to be displayed. In FIG. 5, the vertical axis indicates the amount of remaining toner and the lateral axis indicates time.

As illustrated in FIG. 5, from a time when remaining toner is fully contained to a time when the remaining toner is 100 g corresponding to the first predetermined value, the amount of the remaining toner is calculated by the toner supply amount calculation section 32. When the remaining toner is less than 10 g, the amount of the remaining toner is calculated by the toner consumption amount calculation section 33. Thereafter, when: the amount of the remaining toner is further reduced and reaches the limitation amount $W_L$ corresponding to the third predetermined value, the amount of the remaining toner is detected based on ATC and a message for urging the user to prepare new toner (NNE) is displayed. Thereafter, when "near end" is detected by the remaining toner amount detection section 31, a message for urging the user to exchange toner (NE) is displayed. Further, when "toner runs out" is detected, a message indicating "toner empty" is displayed.

Figure 6:
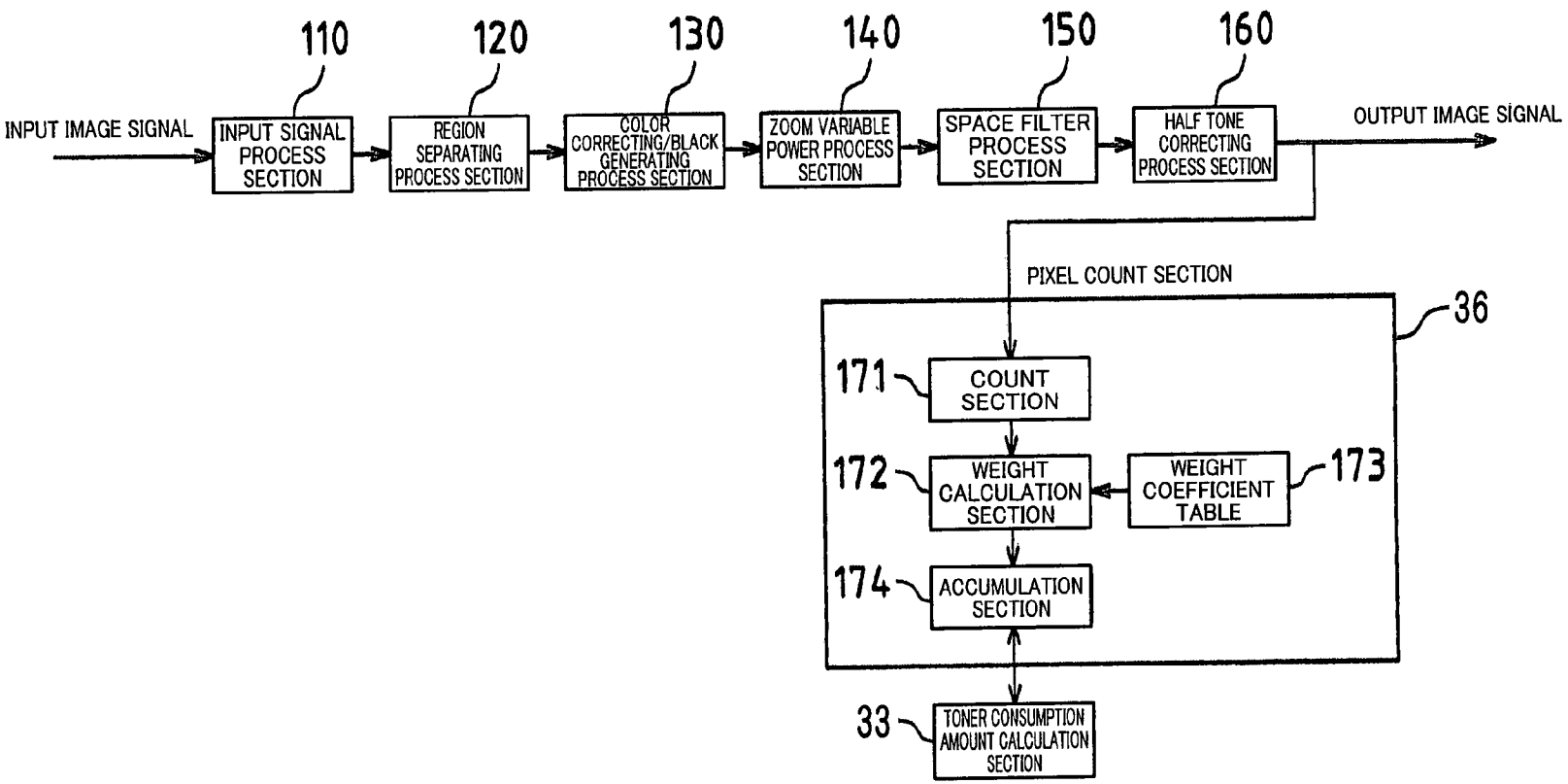
FIG. 6 is a control block diagram illustrating an image process carried out by the image forming apparatus.

Here, with reference to FIG. 6, the following explains calculation of the amount of toner consumption based on the result of pixel count carried out by the toner consumption amount calculation section 33.

FIG. 6 is a control block diagram illustrating an image process carried out by the image forming apparatus 1. Here, a control system of the image process is constituted of an input signal process section 110, a region separating process section 120, a color correcting/black generating process section 130, a variable zoom power process section 140, a space filter process section 150, a half tone correcting process section 160, the pixel count section 36, and the toner consumption amount calculation section 33.

The image process is shortly explained. A digital input image signal of a document read out by a scanner or the like is inputted to the input signal process section 110 and is subject to (i) a pre-process carried out before subsequent image processes, (ii) input gamma correction in image adjustment, (iii) conversion, and the like. Next, the image signal is inputted to the region separating process section 120 and is subject to a region judgment process for judging a character region, a halftone dot picture region, and the like, and an identification signal (region separating identification signal) corresponding to each region is added to the image signal. The region separating identification signal is used when the space filter process section 150 and the half tone correcting process section 160, which perform subsequent processes, perform a process specific to each region. Examples of the process specific to each region include a smoothing filter process for a halftone dot region, an edge emphasizing filter process for a character region, and a process for changing half tone gamma characteristics into characteristics having more sharper difference between light and dark.

A color correcting/black generating process performed in the subsequent color correcting/black generating process section 130 is a process which is necessary in a case where the image forming apparatus is capable of forming color images. The color correcting/black generating process converts the image signals of RGB transmitted from the region separating process section 120 into image signals of CMYK (cyan, magenta, yellow, and black) which are to be finally outputted.

The image signal having been converted into CMYK is subject to a variable power process carried out by the variable zoom power process section 140, and then is inputted to the space filter process section 150. The space filter process section 150 selects, out of a space filter table, a space filter corresponding to the region separating identification signal, a setting state of an image mode, or the like, and performs a space filter process with respect to an image signal having been converted to CMYK. Note that, the space filter table is a table group of filter coefficients which are referred to in performing the space filter process, and any table group can be selected according to situation. The half tone correcting process section 160 corrects half tone gamma characteristics so as to correct output characteristics of an engine section.

Further, the image signal having been subject to the half tone correcting process is inputted to the pixel count section 36 and accumulated by a counter while being weighted with respect to each of CMYK signals by each pixel. Then, the output image signal is outputted to an engine output side of an LSU or an LED. The toner consumption amount calculation section 33 calculates the amount of toner consumption with respect to each color based on the value of pixel counts accumulated by the pixel count section 36.

Next, the following details the calculation of the amount of toner consumption. Note that, the process described below is performed with respect to each of CMYK (with respect to each of inputted CMYK signals).

The pixel count section 36 performs later-mentioned pixel count with respect to an inputted multi-valued image. As illustrated in FIG. 6, the pixel count section 36 includes a count section 171, a weight calculation section 172, a weight coefficient table 173, and an accumulation section 174.

The count section (count means) 171 counts the inputted multi-valued image (for example, an image having multi-gradations such as 16 gradations or 256 gradations) by each pixel. Namely, the count section 171 counts an input signal value (gradation) for each pixel constituting a multi-valued image. For example, in a case of 16 gradations whose input signal value ranges from 0 to 15, the count section 171 counts 0 to 15.

The weight calculation section (weight calculation means) 172 weights each pixel, when pixels are counted by the count section 171. To be specific, the weight calculation section 172 acquires, from the weight coefficient table 173, a weight coefficient corresponding to an input signal value for each pixel, and multiplies an input signal value by the acquired weight coefficient. The weight coefficient table 173 stores a weight coefficient corresponding to each pixel input value at a time when the weight calculation section 172 weights an input signal value. In this way, the pixel count section 36 performs pixel count for each pixel, by use of the count section 171, the weight calculation section 172, and the weight coefficient table 173.

Next, accumulation of pixel counts for each pixel is performed by the accumulation section (accumulation means) 174. Namely, the accumulation section 174 accumulates calculation values of all the pixels of the inputted multi-valued image, each of the calculation values being obtained by the weight calculation section 172 multiplying the input signal value by the weight coefficient. In this way, the toner consumption amount calculation section 33 calculates the amount of toner consumption of an outputted image based on the accumulated value of pixel counts calculated by the pixel count section 36.

FIG. 7 illustrates an example of weight coefficients stored in the weight coefficient table 173. In the example, the input signal value has 16 values, namely, the input signal value ranges from 0 to 15. In FIG. 7, there are provided four areas (areas 1 to 4) each corresponding to an input signal value having different toner consumption, and a weight coefficient is assigned to each area. When pixel count is performed, the weight coefficient assigned to each area is selected according to each input signal value ranging from 0 to 15 and weighting is performed by using the selected weight coefficient.

Figure 8:
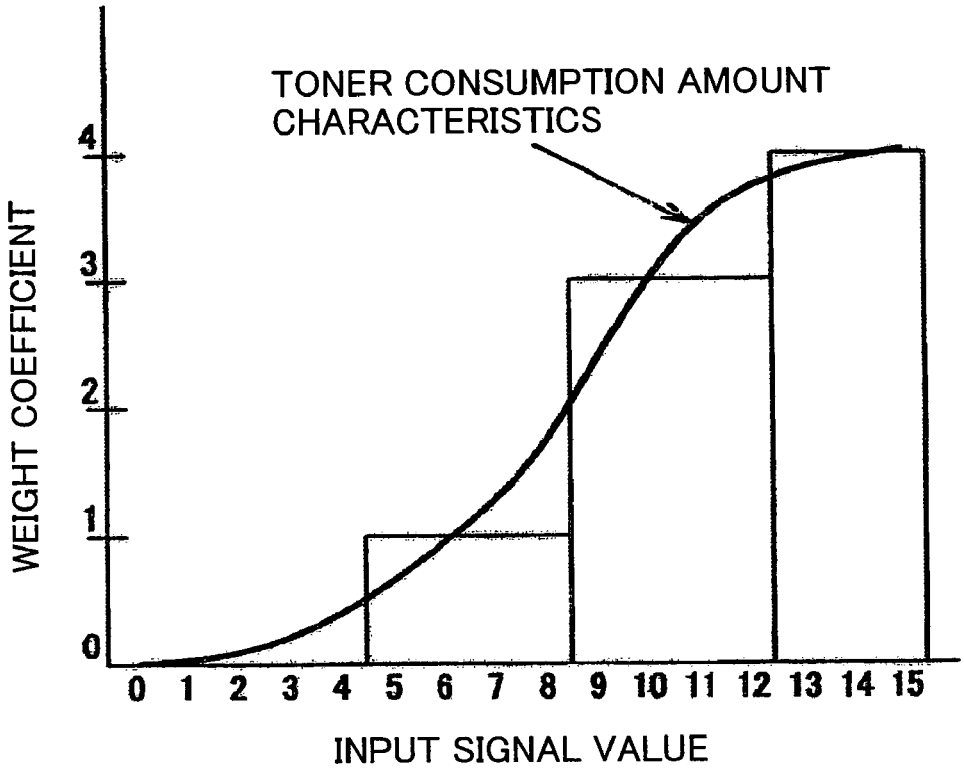
FIG. 8 illustrates a relation between a signal input value and the amount of toner consumption, and a relation between the signal input value and a weight coefficient.

FIG. 8 illustrates a relation between (i) the signal input values in a weight coefficient table divided into four areas and (ii) weight coefficients corresponding to the signal input values. As illustrated in FIG. 8, the sum of the areas of rectangular portions is substantially equal to the area of a curve indicative of the consumption amount characteristics, so that it is possible to predict and calculate the amount of toner consumption based on the accumulated value of pixel count after weighting.

Note that, in the example illustrated in FIG. 7, the weight coefficients stored in the weight coefficient table 173 are fixed values. However, the weight coefficient may be changed so that the amount of toner consumption calculated by the toner consumption calculation section 33 corresponds to the actual amount of toner consumption.

Further, the present invention may be arranged so that: a dot count section for counting, based on image information, the number of times printed dots are formed is provided instead of the pixel count section 36, and the toner consumption amount calculation section 33 calculates the amount of toner consumption based on the result of count carried out by the dot count section. In a case where the number of dots is counted, too, a predetermined weight coefficient is multiplied by the number. As disclosed in Japanese Unexamined Patent Publication No. 163553/2004 and Japanese Unexamined Patent Publication No. 163554/2004, by changing the weight coefficient according to use history of toner or changing the weight coefficient according to three classifications of dots such as an isolated dot, two-continuous dots, and three-continuous dots, it is possible to calculate the amount of toner consumption more precisely.

Figure 9:
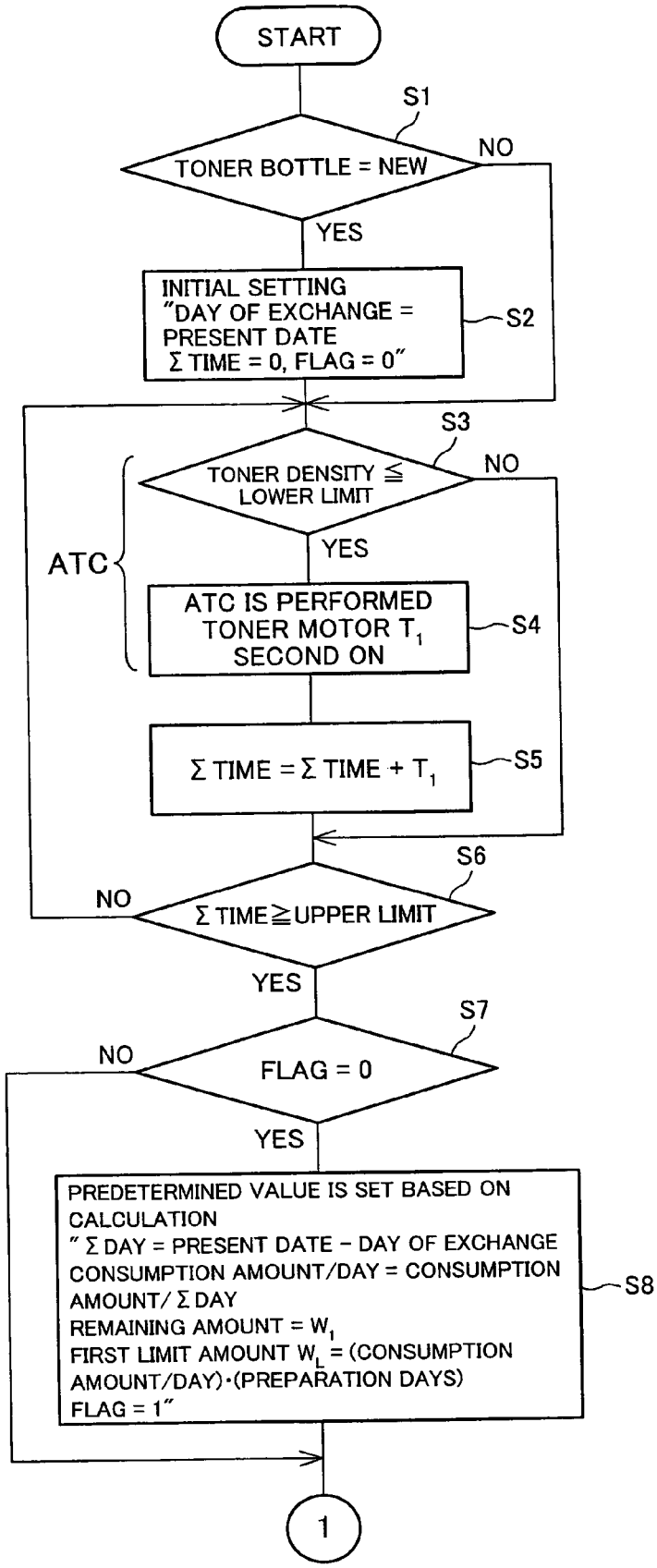
FIG. 9 is a flowchart illustrating a procedure of the image forming apparatus, in which the amount of remaining toner is detected and a user is informed of information indicative of the amount of remaining toner based on the result of the detection.
Figure 10:
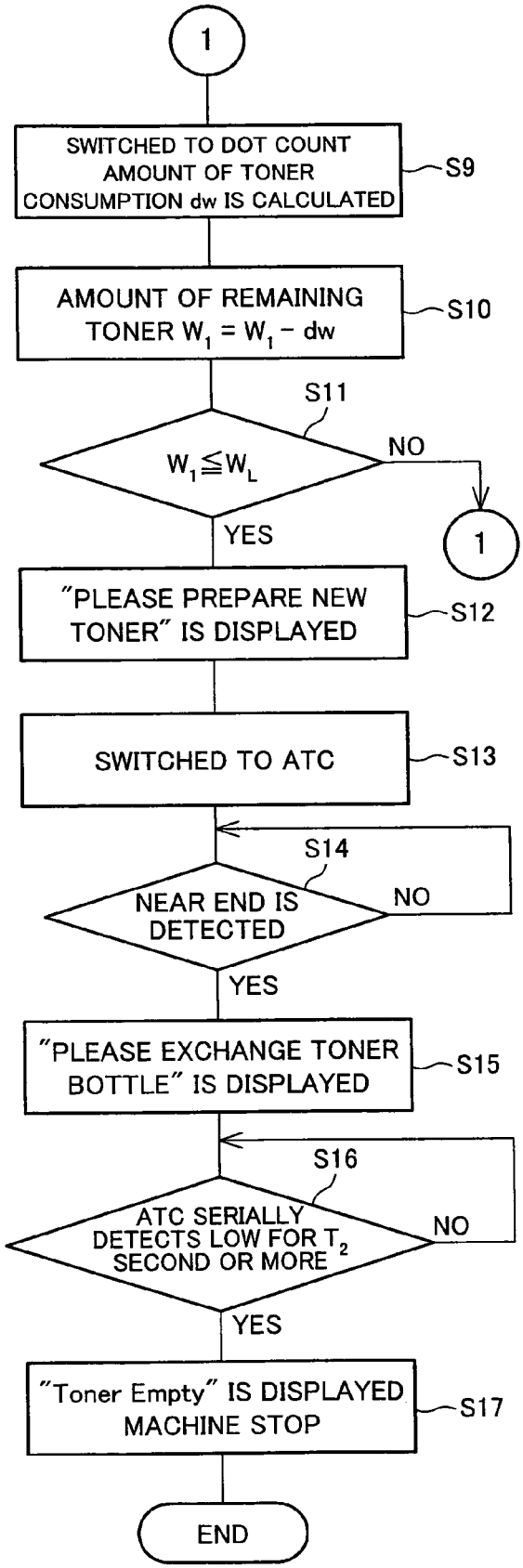
FIG. 10 is a flowchart illustrating a procedure of the image forming apparatus, in which the amount of remaining toner is detected and a user is informed of information indicative of the amount of remaining toner based on the result of the detection.

With reference to flowcharts in FIGS. 9 and 10, the following explains a process of the image forming apparatus 1, in which process the amount of remaining toner is detected and the user is informed of information indicative of the amount of remaining toner based on the result of the detection. Here, an example in which the predetermined value setting section 39 sets the limit amount $W_L$ is explained.

The remaining toner amount detection section 31 and the predetermined value setting section 39 determine whether the toner bottle 17 is new or not (S1). When the toner bottle 17 is new, the remaining toner amount detection section 31 and the predetermined value setting section 39 perform initial setting (S2). The predetermined value setting section 39 stores the present date as the day of exchange of the toner bottle 17 in a memory (not shown) and causes a flag for indicating whether a predetermined value is set or not to be "0" indicating that a predetermined value is not set. Further, the remaining toner amount detection section 31 causes accumulated rotational time (Σ time) of the accumulated rotational time measurement section 35 to be "0".

Next, the remaining toner amount detection section 31 causes the toner supply amount calculation section 32 to calculate the amount of toner supply. Each time when the toner motor is rotated for a predetermined time ($T_1$ second) in ATC (S3 and S4) carried out by the toner density control section 34, the accumulated rotational time measurement section 35 increases the accumulated rotational time (Σ time) by $T_1$ (S5). The remaining toner amount detection section 31 determines whether the accumulated rotational time measured by the accumulated rotational time measurement section 35 reaches the upper limit or not (S6).

The upper limit of the accumulated rotational time (Σ time) in S6 corresponds to the accumulated rotational time with which toner is supplied so that the amount of remaining toner in the toner bottle 17 becomes the first predetermined value. For example, in a case where the initial amount of toner in the toner bottle 17 is 360 g and the first predetermined value is 100 g, the upper limit of the rotational time is a time with which toner (360−100=260 g) is supplied.

When it is judged that the accumulated rotational time (Σ time) reaches the upper limit, the remaining toner amount detection section 31 changes the method for detecting the amount of remaining toner from detection carried out by the toner supply amount calculation section 32 to detection carried out by the toner consumption amount calculation section 33 and informs the change to the predetermined value setting section 39. Note that, when the accumulated rotational time (Σ time) does not reach the upper limit, the process goes back to S3.

When the remaining toner amount detection section 31 judges that the accumulated rotational time reaches the upper limit, the predetermined value setting section 39 judges whether the flag is "0" or not. When the flag is "0", the process goes to S8 and a predetermined value is set based on calculation. When the flag is not "0", because the predetermined value has already been set based on calculation, the predetermined value is not set based on the calculation in S8.

In S8, the consumption amount/day calculation section calculates, based on the number of days having passed since the day when the toner bottle was exchanged, the number of days Σ Day taken for the amount of toner to have the first predetermined value, and divides the amount of toner supply by the number of days, thereby obtaining the amount of consumption per day (the amount of consumption/day). Next, the predetermined value calculation section multiplies the calculated amount of consumption/day by preparation days having been set with respect to each user, thereby obtaining the limit amount $W_L$ which is the third predetermined value. When the predetermined value is set, the predetermined value setting section 39 causes the flag to be "1".

Next, the remaining toner amount detection section 31 causes the toner consumption amount calculation section 33 to calculate the amount of toner consumption dw (S9), subtracts the amount of toner consumption dw from the amount of remaining toner $W_1$ (equal to the first predetermined value) (S10), and judges whether the amount of remaining toner $W_1$ reaches the limit amount $W_L$ or not (S11). When the amount of remaining toner $W_1$ does not reach the limit amount $W_L$, the process goes back to S9.

On the other hand, when the amount of remaining toner $W_1$ reaches the limit amount $W_L$, the remaining toner amount detection section 31 informs the remaining amount informing section 41 that the amount of remaining toner $W_1$ reaches the limit amount $W_L$, and the remaining amount informing section 41 causes a message for urging preparation of new toner to be displayed (S12). Further, when the amount of remaining toner $W_1$ reaches the limit amount $W_L$, the remaining toner amount detection section 31 changes detection of remaining toner from detection carried out by the toner consumption amount calculation section 33 to detection of "near end" or "toner runs out" which is carried out by the toner density control section 34 (S13).

The remaining toner amount detection section 31 judges whether toner is near end or not (S14), and repeats the process until the remaining toner amount detection section 31 judges that the toner is near end. On the other hand, when the remaining toner amount detection section 31 judges that the toner is near end, the remaining toner amount detection section 31 informs the remaining amount informing section 41 that "near end" is detected, and the remaining amount informing section 41 causes a message for urging exchange of the toner bottle 17 to be displayed (S15).

Thereafter, the toner density control section 34 judges whether the toner runs out or not (S16), and repeats the process until the toner density control section 34 judges that the toner runs out. Here, the toner density control section 34 judges whether toner density continues to be less than the limit value for a predetermined time ($T_2$) or more. When the toner density continues to be less than the limit value for the predetermined time ($T_2$) or more, the remaining toner amount detection section 31 judges that the toner runs out. When the remaining toner amount detection section 31 judges that the toner runs out, the remaining toner amount detection section 31 informs the remaining amount informing section 41 and the machine stopping section 43 that the toner runs out.

When the remaining toner amount detection section 31 judges that the toner runs out, the remaining amount informing section 41 causes a message indicating that toner runs out to be displayed, and the machine stopping section 43 stops the image forming apparatus 1 (S17).

As described above, in the image forming apparatus 1, the remaining toner amount detection section 31 detects the amount of remaining toner by using the result of calculation carried out by the toner supply amount calculation section 32 based on accumulated rotational time of the toner motor in a region where the amount of remaining toner in the supply device is not less than a predetermined amount and changes linearly in accordance with the number of rotations or the rotational time of the supply motor and thus stabilizes the amount of toner supply (until the amount of remaining toner reaches the first predetermined value). Further, the remaining toner amount detection section 31 detects the amount of remaining toner by using the result of calculation carried out by the toner consumption amount calculation section 33 based on pixel counts in a region where the amount of remaining toner in the supply device gets small and the amount of toner supply gets uneven (from the first predetermined value to the second predetermined value). Further, the remaining toner amount detection section 31 detects the amount of remaining toner by using the result of ATC carried out by the toner density control section 34 in a region where toner is near end.

This allows detection of the amount of remaining toner according to actually remaining toner. As a result, it is possible to exactly detect the amount of remaining toner from a time when toner is fully contained to a time when toner runs out without including a special remaining toner detection device. Further, unlike detection of the amount of remaining toner carried out only by ATC, it is possible to chronologically detect the amount of remaining toner from the time when toner is fully contained to the time when toner runs out, so that it is possible to easily inform the user of information concerning toner at a suitable timing by use of the remaining amount informing section 41 and the like.

Further, in the present embodiment, the second predetermined value with which the method for detecting the amount of remaining toner is changed from a method based on calculation carried out by the toner consumption amount calculation section 33 to a method based on control carried out by the toner density control section 34 is the same as the limit amount $W_L$ (third predetermined value). However, the second predetermined value may be set as the second limit amount $W_p$ with respect to each user. The second limit amount $W_P$ may be set so as to have a value which allows, for example, 50 sheets of images to be formed.

When the second predetermined value is set as the second limit amount $W_P$, it is preferable that the second limit amount $W_P$ can be inputted via the input section 38 and the predetermined amount setting section 39 can set the second limit amount $W_P$ based on calculation. Namely, the accumulated number of sheets after the toner bottle 17 is exchanged is measured, the value obtained by subtracting the first predetermined value from the initial amount of toner in the toner bottle 17 is divided by the accumulated number of sheets, thereby calculating the amount of toner consumption per sheet (consumption/sheet) in a region where the amount of remaining toner in the toner bottle 17 changes linearly in accordance with the accumulated number of rotations of the supply motor. Then, thus calculated amount of toner consumption/sheet is multiplied by the limited number of sheets having been set with respect to each user, thereby calculating the second limit amount $W_P$.

In the detection of the amount of remaining toner based on the result of control carried out by the toner density control section 34, the amount of reduced toner is not directly detected. Therefore, in a case where the limit amount $W_L$ (third predetermined value) is set and a message urging preparation of toner is displayed, it is necessary to display the message at the same time or before the detection of the amount of remaining toner switches to the detection based on the result of control carried out by the toner density control section 34. As such, it is preferable that the second limit amount $W_P$ is not more than the limit amount $W_L$ (third predetermined value).

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

Note that, each section (except for the input section and the display section) included in the image forming apparatus 1 according to the present embodiment is a functional block realized in such a manner that: operation means such as a CPU (Central Processing Unit) executes a program stored in storage means such as a ROM (Read Only Memory), RAM (Random Access Memory), and the like, and controls input means (input section) such as a keyboard, output means (display section) such as a display, or communication means such as an interface circuit.

Therefore, a computer having these means reads a storage medium for storing the program and executes the program, thereby realizing functions and processes of the image forming apparatus 1 according to the present invention.

Such a computer program storage medium may be a memory (not shown), such as a ROM, so that the process is executable on a microcomputer. Alternatively, a program medium may be used which can be read by inserting the storage medium in an external storage device (program reader device; not shown).

In addition, in either of the cases, it is preferable if the contained program is accessible to a microprocessor which will execute the program. Further, it is preferable if the program is read, and the program is then downloaded to a program storage area of a microcomputer where the program is executed. Assume that the program for download is stored in a main body device in advance.

In addition, the program medium is a storage medium arranged so that it can be separated from the main body. Examples of such a program medium include a tape, such as a magnetic tape and a cassette tape; a magnetic disk, such as a flexible disk and a hard disk; a disc, such as a CD/MO/MD/DVD; a card, such as an IC card (inclusive of a memory card); and a semiconductor memory, such as a mask ROM, an EPROM (erasable programmable read only memory), an EEPROM (electrically erasable programmable read only memory), or a flash ROM. All these storage media hold a program in a fixed manner.

Alternatively, if a system can be constructed which can connects to the Internet or other communications network, it is preferable if the program medium is a storage medium carrying the program in a flowing manner as in the downloading of a program over the communications network.

Further, when the program is downloaded over a communications network in this manner, it is preferable if the program for download is stored in a main body device in advance or installed from another storage medium.

As described above, the image forming apparatus according to the present invention is an image forming apparatus, which uses two-component developer constituted of toner and carrier and includes toner density control means for supplying the toner from a supply device to a developing device on the basis of magnetic permeability of the developer so as to cause toner density in the developing device to be constant, the image forming apparatus including remaining toner amount detection means for detecting the amount of remaining toner in the supply device, wherein the remaining toner amount detection means includes: toner supply amount calculation means for calculating the amount of toner supply on the basis of the accumulated number of rotations of a supply motor which is rotated so as to supply toner from the supply device to the developing device; toner consumption amount calculation means for calculating the amount of toner consumed by forming an image on the basis of image information; and the toner density control means, and the remaining toner amount detection means detects the amount of remaining toner on the basis of (i) the result of calculation carried out by the toner supply amount calculation means till the amount of remaining toner in the supply device reaches a first predetermined value, (ii) the result of calculation carried out by the toner consumption amount calculation means from a time when the amount of remaining toner in the supply device reaches the first predetermined value till the amount of remaining toner in the supply device reaches a second predetermined value, and (iii) the result of control carried out by the toner density control means from a time when the amount of remaining toner in the supply device reaches the second predetermined value.

With the arrangement, the amount of remaining toner in the supply device is detected on the basis of (i) the amount of toner supply which is calculated by the toner supply amount calculation means based on the accumulated number of rotations of the supply motor till the amount of remaining toner in the supply device reaches the first predetermined value, (ii) the amount of toner consumption which is calculated by the toner consumption amount calculation means based on the image information from the time when the amount of remaining toner in the supply device reaches the first predetermined value till the amount of remaining toner in the supply device reaches the second predetermined value, and (iii) the result of control carried out by the toner density control means from the time when the amount of remaining toner in the supply device reaches the second predetermined value.

Namely, the amount of remaining toner is detected based on the accumulated number of rotations of the toner motor in a region where the amount of remaining toner in the supply device is not less than a predetermined amount and changes linearly in accordance with the number of rotations or the rotational time of the supply motor and thus stabilizes the amount of toner supply. Further, the amount of remaining toner is detected by expecting the amount of consumed toner based on the image information in a region where the amount of remaining toner in the supply device gets small and the amount of toner supply gets uneven. Further, the amount of remaining toner is detected by using the result of control carried out by the conventional toner density control means in a region where the amount of toner is near end.

As a result, it is possible to detect the amount of toner according to actually remaining toner, and accordingly it is possible to exactly detect the amount of remaining toner from a time when toner is fully contained to a time when toner runs out without providing a special remaining toner detection device.

Further, unlike the detection carried out only by ATC with respect to the amount of remaining toner, it is possible to chronologically detect the amount of remaining toner from a time when toner is fully contained to a time when toner runs out, so that it is easy to inform the user of information concerning toner at a suitable timing.

The first predetermined value can be set to a value within a region where the amount of remaining toner in the supply device changes linearly in accordance with the accumulated number of rotations of the supply motor and the second predetermined value can be set to a value which allows detection of the amount of remaining toner on the basis of the result of the control carried out by the toner density control means even when an error occurs in the calculation carried out by the toner consumption amount calculation means.

Further, the image forming apparatus according to the present invention may be arranged so that: a third predetermined value is set in accordance with the amount of used toner per days taken for a user to obtain a supply device for exchange, and there is provided informing means (an informing section) which causes a display section to inform a user that preparation of toner is necessary when detection carried out by the remaining toner amount detection means with respect to the amount of remaining toner shows that the amount of remaining toner in the supply device reaches the third predetermined value.

With the arrangement, when the amount of remaining toner reaches the third predetermined value which is set in accordance with the amount of used toner per days taken for the user to obtain a supply device for exchange, the informing means causes the display section to urge preparation of toner, so that the user can prepare the next toner at a suitable timing and accordingly it is possible to prevent reduction of an operation rate of the image forming apparatus.

The image forming apparatus may be arranged so as to include correcting means for causing the toner consumption amount calculation means to calculate the amount of toner consumption as well as causing the toner supply amount calculation means to calculate the amount of toner supply while the amount of remaining toner in the supply device has not yet reached the first predetermined value, so as to correct the toner consumption amount calculation means on the basis of the result of the calculation carried out by the toner supply amount calculation means with respect to the amount of toner supply.

The toner supply amount calculation means highly accurately carries out calculation in a region where the amount of remaining toner in the supply device changes linearly in accordance with the number of rotations and the rotational time of the supply motor. In the arrangement, by use of the high accuracy, the toner consumption amount calculation means is corrected based on the result of calculation carried out by the toner supply amount calculation means with high accuracy, so that it is possible to increase accuracy in calculating the amount of toner consumption carried out by the toner consumption amount calculation means.

The image forming apparatus according to the present invention may be arranged so that the toner consumption amount calculation means counts, based on the image information, how many times printing dots are formed, so as to calculate the amount of toner consumption.

Further, the image forming apparatus according to the present invention may be arranged so that: the toner consumption amount calculation means performs an image process and a correction process with respect to the image information in a digital manner and performs pixel count of an input multi-valued image so as to calculate the amount of toner consumption, and the toner consumption amount calculation means includes count means (count section) for counting an input signal value of the input multi-valued image with respect to each pixel, a weight coefficient table for storing a weight coefficient corresponding to the input signal value, and weight calculation means (calculation section) for acquiring the weight coefficient corresponding to the input signal value from the weight coefficient table and performs weighting with respect to each pixel when the count means counts the input signal value.

With the arrangement, it is possible to perform weighting in accordance with gradations of image information unlike calculation of the amount of toner consumption by counting formed dots, so that it is possible to calculate the amount of toner consumption with higher accuracy.

Further, the image forming apparatus according to the present invention may be arranged so as to include an input section which allows external setting of the first, second, and third predetermined values.

The first and second predetermined values vary with respect to each image forming apparatus and vary because of version up/down of the supply device. Therefore, by allowing such external setting, it is possible to handle variation with respect to each image forming apparatus or version up/down of the supply device. Further, because the third predetermined value is different with respect to each user, by allowing the third predetermined value to be suitably set via the input section, it is possible to inform the user of the message at a timing suitable for each user.

Further, the image forming apparatus according to the present invention may be arranged so that: the image forming apparatus includes predetermined value setting means (predetermined value setting section) for setting the third predetermined value on the basis of calculation, and the predetermined value setting means includes (i) consumption amount/day calculation means (consumption amount/day calculation section) for subtracting the first predetermined value from an initial amount of toner in the supply device and dividing thus obtained value by days which have passed from a day when the supply device was exchanged to a day when the amount of remaining toner reaches the first predetermined value, so as to obtain an amount of toner used by the user per day, and (ii) predetermined value calculation means (predetermined value calculation section) for multiplying consumption amount/day calculated by the consumption amount/day calculation means by preparation days inputted with respect to each user, so as to calculate the third predetermined value.

With the arrangement, the consumption amount/day calculation section calculates the amount of toner consumption per day and the predetermined value calculation section calculates the third predetermined value by multiplying the amount of toner consumption per day calculated by the consumption amount/day calculation section by the preparation days which are set with respect to each user. As a result, the timing for informing the user of the message gets more suitable, so that it is possible to urge the user to prepare new toner at a timing desired by the user (including preparation days).

The image forming apparatus according to the present invention may be arranged so that: the supply device includes a cylindrical container which contains the toner and which is disposed in a lateral manner, and the container is rotated so that an axis of the container is a rotational axis, so as to supply the toner from an opening provided on a cylindrical face of the container to the developing device.

The supply device having such a rotation mechanism is stable in terms of the amount of toner supply per one rotation. Therefore, when the supply device is used in the arrangement in which the amount of remaining toner is detected based on the amount of toner supply obtained from the accumulated number of rotations of the supply motor, it is possible to detect the amount of remaining toner with high accuracy.

The method according to the present invention for detecting the amount of remaining toner is a method for detecting the amount of remaining toner in a supply device applied to an image forming apparatus that uses two-component developer constituted of toner and carrier and that includes toner density control means for supplying the toner from the supply device to a developing device on the basis of magnetic permeability of the developer so as to cause toner density in the developing device to be constant, the method including the steps of (i) detecting the amount of remaining toner in the supply device on the basis of the accumulated number of rotations of the supply motor which supplies the toner from the supply device to the developing device in a region where the amount of remaining toner in the supply device is large and changes linearly in accordance with the accumulated number of rotations of the supply motor, (ii) detecting the amount of remaining toner in the supply device on the basis of the amount of toner consumed by forming an image on the basis of image information in a region where the amount of remaining toner in the supply device is small and does not change linearly in accordance with the accumulated number of rotations of the supply motor, and (iii) detecting the amount of remaining toner in the supply device on the basis of the result of control carried out by the toner density control means in a region where the amount of remaining toner is substantially 0.

In the method for detecting the amount of remaining toner as well as in the image forming apparatus already explained above, it is possible to detect the amount of remaining toner according to actually remaining toner, and accordingly it is possible to exactly detect the amount of remaining toner from a time when toner is fully contained to a time when toner runs out without providing a special remaining toner detection device and it can be easily realized to inform the user of information concerning toner at a suitable timing.

What is claimed is:

1. An image forming apparatus, which uses two-component developer constituted of toner and carrier and includes toner density control means for supplying the toner from a supply device to a developing device on the basis of magnetic permeability of the developer so as to cause toner density in the developing device to be constant, said image forming apparatus comprising remaining toner amount detection means for detecting an amount of remaining toner in the supply device, wherein the remaining toner amount detection means includes:

toner supply amount calculation means for calculating an amount of toner supply on the basis of an accumulated number of rotations of a supply motor which is rotated so as to supply toner from the supply device to the developing device;

toner consumption amount calculation means for calculating an amount of toner consumed by forming an image on the basis of image information; and the toner density control means, wherein the remaining toner amount detection means detects the amount of remaining toner on the basis of (i) a result of calculation carried out by the toner supply amount calculation means till the amount of remaining toner in the supply device reaches a first predetermined value, (ii) a result of calculation carried out by the toner consumption amount calculation means from a time when the amount of remaining toner in the supply device reaches the first predetermined value till the amount of remaining toner in the supply device reaches a second predetermined value, and (iii) a result of control carried out by the toner density control means from a time when the amount of remaining toner in the supply device reaches the second predetermined value.

2. The image forming apparatus as set forth in claim 1, wherein the first predetermined value is set to a value within a region where the amount of remaining toner in the supply device changes linearly in accordance with the accumulated number of rotations of the supply motor.

3. The image forming apparatus as set forth in claim 1, wherein the second predetermined value is set to a value which allows detection of the amount of remaining toner on the basis of the result of the control carried out by the toner density control means even when an error occurs in the calculation carried out by the toner consumption amount calculation means.

4. The image forming apparatus as set forth in claim 1, comprising correcting means for causing the toner consumption amount calculation means to calculate the amount of toner consumption as well as causing the toner supply amount calculation means to calculate the amount of toner supply till the amount of remaining toner in the supply device reaches the first predetermined value, so as to correct the toner consumption amount calculation means on the basis of the result of the calculation carried out by the toner supply amount calculation means with respect to the amount of toner supply.

5. The image forming apparatus as set forth in claim 1, wherein the toner consumption amount calculation means counts, based on the image information, how many times printing dots are formed, so as to calculate the amount of toner consumption.

6. The image forming apparatus as set forth in claim 1, wherein the toner consumption amount calculation means performs an image process and a correction process with respect to the image information in a digital manner and performs pixel count of an input multi-valued image so as to calculate the amount of toner consumption, and the toner consumption amount calculation means includes:

count means for counting an input signal value of the input multi-valued image with respect to each pixel;

a weight coefficient table for storing a weight coefficient corresponding to the input signal value, and weight calculation means for acquiring the weight coefficient corresponding to the input signal value from the weight coefficient table and performs weighting with respect to each pixel when the count means counts the input signal value.

7. The image forming apparatus as set forth in claim 1, further comprising an input section which allows external setting of the first and second predetermined values.

8. The image forming apparatus as set forth in claim 1, further comprising informing means for causing a display section to inform a user that preparation of toner is necessary, wherein the informing means causes the display section to inform the user that preparation of toner is necessary when detection carried out by the remaining toner amount detection means with respect to the amount of remaining toner shows that the amount of remaining toner in the supply device reaches a third predetermined value which is set in accordance with the amount of used toner per days taken for the user to obtain a supply device for exchange.

9. The image forming apparatus as set forth in claim 8, further comprising an input section which allows external setting of the third predetermined value.

10. The image forming apparatus as set forth in claim 8, wherein the second predetermined value is not more than the third predetermined value.

11. The image forming apparatus as set forth in claim 8, comprising predetermined value setting means for setting the third predetermined value on the basis of calculation, wherein the predetermined value setting means includes:

consumption amount/day calculation means for subtracting the first predetermined value from an initial amount of toner in the supply device and dividing thus obtained value by days which have passed from a day when the supply device was exchanged to a day when the amount of remaining toner reaches the first predetermined value, so as to calculate consumption amount/day consumed by the user; and predetermined value calculation means for multiplying the consumption amount/day calculated by the consumption amount/day calculation means by preparation days inputted with respect to each user, so as to calculate the third predetermined value.

12. The image forming apparatus as set forth in claim 1, wherein: the supply device includes a cylindrical container which contains the toner and which is disposed in a lateral manner, and the container is rotated so that an axis of the container is a rotational axis, so as to supply the toner from an opening provided on a cylindrical face of the container to the developing device.

13. A remaining toner detection program, which is applied to an image forming apparatus that uses two-component developer constituted of toner and carrier and that includes toner density control means for supplying the toner from a supply device to a developing device on the basis of magnetic permeability of the developer so as to cause toner density in the developing device to be constant, said remaining toner detection program being used to detect an amount of remaining toner in the supply device, said remaining toner detection program causing a computer to function as means included in the image forming apparatus as set forth in claim 1 or 8.

14. A computer-readable storage medium for storing the program as set forth in claim 13.

15. A method for detecting an amount of remaining toner in a supply device applied to an image forming apparatus that uses two-component developer constituted of toner and carrier and that includes toner density control means for supplying the toner from the supply device to a developing device on the basis of magnetic permeability of the developer so as to cause toner density in the developing device to be constant, said method comprising the steps of:

(i) detecting the amount of remaining toner in the supply device on the basis of an accumulated number of rotations of a supply motor which supplies the toner from the supply device to the developing device;

(ii) detecting the amount of remaining toner in the supply device on the basis of an amount of toner consumed by forming an image on the basis of image information; and (iii) detecting the amount of remaining toner in the supply device on the basis of a result of control carried out by the toner density control means, wherein the step (i) is performed in a region where the amount of remaining toner in the supply device is large and changes linearly in accordance with the accumulated number of rotations of the supply motor, the step (ii) is performed in a region where the amount of remaining toner in the supply device is small and does not change linearly in accordance with the accumulated number of rotations of the supply motor, and the step (iii) is performed in a region where the amount of remaining toner is substantially 0.

16. A method for detecting an amount of remaining toner in a supply device applied to an image forming apparatus that uses two-component developer constituted of toner and carrier and that includes toner density control means for supplying the toner from the supply device to a developing device on the basis of magnetic permeability of the developer so as to cause toner density in the developing device to be constant, said method comprising the steps of:

(i) detecting the amount of remaining toner in the supply device on the basis of an accumulated number of rotations of a supply motor which supplies the toner from the supply device to the developing device;

(ii) detecting the amount of remaining toner in the supply device on the basis of an amount of toner consumed by forming an image on the basis of image information; and (iii) detecting the amount of remaining toner in the supply device on the basis of a result of control carried out by the toner density control means, wherein the step (i) is performed when the amount of remaining toner in the supply device is large and changes linearly in accordance with the accumulated number of rotations of the supply motor, and the step (i) is switched to the step (ii) when the amount of remaining toner in the supply device reaches a region where the amount is small and does not change linearly in accordance with the accumulated number of rotations of the supply motor, and the step (ii) is switched to the step (iii) when the amount of remaining toner reaches a region where the amount is substantially 0.

* * * * *